US011761290B2

(12) United States Patent
Greci et al.

(10) Patent No.: US 11,761,290 B2
(45) Date of Patent: Sep. 19, 2023

(54) REACTIVE METAL SEALING ELEMENTS FOR A LINER HANGER

(71) Applicant: Halliburton Energy Services, Inc., Houston, TX (US)

(72) Inventors: Stephen Michael Greci, Little Elm, TX (US); Michael Linley Fripp, Carrollton, TX (US); Emile Edmund Sevadjian, Carrollton, TX (US); Abdolreza Gharesi, Southlake, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/718,727

(22) Filed: Dec. 18, 2019

(65) Prior Publication Data

US 2021/0189830 A1 Jun. 24, 2021

(51) Int. Cl.
*E21B 33/12* (2006.01)
*E21B 23/06* (2006.01)

(52) U.S. Cl.
CPC ..... *E21B 33/1212* (2013.01); *E21B 23/06* (2013.01)

(58) Field of Classification Search
CPC ..... E21B 33/1212; E21B 23/06
See application file for complete search history.

(56) References Cited

U.S. PATENT DOCUMENTS 1,982,569 A 11/1934 Byrd
3,046,601 A 7/1962 Hubbert et al.
3,385,367 A 5/1968 Kollsman
3,993,577 A 11/1976 Black et al.
4,445,694 A 5/1984 Flaherty
4,612,985 A 9/1986 Rubbo et al.
4,846,278 A 7/1989 Robbins
5,070,942 A 12/1991 McInnes
5,139,235 A 8/1992 Kilmer
5,163,321 A 11/1992 Perales
(Continued)

FOREIGN PATENT DOCUMENTS

CA 2751473 A1 8/2010
CA 2751473 C 9/2014
(Continued)

OTHER PUBLICATIONS

International Search Report and Written Opinion for corresponding PCT International Application No. PCT/US2019/068497; dated Sep. 17, 2020.
(Continued)

*Primary Examiner* — Dany E Akakpo
(74) *Attorney, Agent, or Firm* — Barnes & Thornburg, LLP

(57) ABSTRACT

Methods for treating a wellbore. An example method includes positioning a conduit in the wellbore. The conduit is a liner hanger or a tie-back liner. The conduit includes a conduit body and a reactive metal sealing element disposed on the conduit body. The reactive metal sealing element includes a reactive metal having a first volume. The method further includes contacting the reactive metal with a fluid that reacts with the reactive metal to produce a reaction product having a second volume greater than the first volume. The method further includes contacting a surface adjacent to the reactive metal sealing element with the reaction product.

18 Claims, 9 Drawing Sheets

(56) References Cited

U.S. PATENT DOCUMENTS 5,803,177 A 9/1998 Hriscu et al.
6,098,717 A 8/2000 Bailey et al.
6,321,861 B1 11/2001 Leichter
6,367,845 B1 4/2002 Otten et al.
6,581,682 B1 6/2003 Parent et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Xu et al.
9,624,752 B2 4/2017 Resink
9,702,029 B2 7/2017 Fripp et al.
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Masques
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2003/0159829 A1 8/2003 Fripp et al.
2004/0118572 A1 6/2004 Whanger et al.
2004/0149418 A1 8/2004 Bosma et al.
2004/0244994 A1* 12/2004 Jackson ..... E21B 43/103 166/384
2005/0039927 A1 2/2005 Wetzel et al.
2005/0092485 A1 5/2005 Brezinski
2005/0171248 A1 8/2005 Li et al.
2005/0199401 A1 9/2005 Patel et al.
2005/0257961 A1 11/2005 Snell et al.
2006/0039927 A1 2/2006 Aoki et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1* 6/2008 Marya ..... E21B 23/00 166/387
2008/0185150 A1 8/2008 Brown
2008/0185158 A1 8/2008 Chalker et al.
2008/0194717 A1 8/2008 Vaidya et al.
2008/0220991 A1 9/2008 Slay et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0163252 A1 7/2010 Regnault De La Mothe et al.
2010/0212891 A1 8/2010 Stewart et al.
2010/0270031 A1 10/2010 Patel
2010/0003077 A1 12/2010 Sponchia et al.
2011/0073310 A1 3/2011 Clemens
2011/0098202 A1 4/2011 James et al.
2011/0174504 A1 7/2011 Wright et al.
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205091 A1* 8/2012 Turley ..... E21B 33/1295 166/77.53
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2012/0318513 A1 12/2012 Mazyar et al.
2013/0056196 A1 3/2013 Hench
2013/0056207 A1 3/2013 Wood et al.
2013/0056227 A1 3/2013 Sponchia
2013/0056228 A1 3/2013 Gruetzmann et al.
2013/0146312 A1 6/2013 Gerrard et al.
2013/0248179 A1 9/2013 Yeh et al.
2014/0051612 A1* 2/2014 Mazyar ..... E21B 33/1208 507/269
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Drager et al.
2015/0369027 A1 12/2015 Jones et al.
2016/0032696 A1 2/2016 Caccialupi et al.
2016/0097252 A1 4/2016 Resink
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0273299 A1 9/2016 Fripp et al.
2016/0312586 A1* 10/2016 De Clute-Melancon ..... E21B 7/04
2016/0319633 A1 11/2016 Cooper et al.
2016/0326829 A1 11/2016 Dolog et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0234103 A1 8/2017 Frazier
2017/0261137 A1 9/2017 Williams et al.

(56) References Cited

U.S. PATENT DOCUMENTS

| | | | |
|---|---|---|---|
| 2017/0335673 | A1 | 11/2017 | Burke et al. |
| 2018/0078998 | A1 | 3/2018 | Sherman |
| 2018/0085154 | A1 | 3/2018 | Kulper et al. |
| 2018/0087346 | A1 | 3/2018 | Rochen |
| 2018/0087350 | A1 | 3/2018 | Sherman |
| 2018/0094492 | A1 | 4/2018 | Knapp et al. |
| 2018/0202271 | A1 | 7/2018 | Semple et al. |
| 2018/0245420 | A1 | 8/2018 | Ringgenberg |
| 2018/0266215 | A1 | 9/2018 | Fagley, IV et al. |
| 2018/0320472 | A1 | 11/2018 | Fripp et al. |
| 2018/0355691 | A1 | 12/2018 | Andersen |
| 2018/0355693 | A1* | 12/2018 | Ai-Abduljabbar ..... E21B 33/1208 |
| 2019/0017285 | A1 | 1/2019 | Kain |
| 2019/0055808 | A1 | 2/2019 | Krueger |
| 2019/0055839 | A1 | 2/2019 | Skillingstad et al. |
| 2019/0128074 | A1 | 5/2019 | Stokes et al. |
| 2019/0153852 | A1 | 5/2019 | Lallemand et al. |
| 2019/0203101 | A1 | 7/2019 | Dusterhoft et al. |
| 2019/0249509 | A1 | 8/2019 | Jakkula et al. |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0079756 | A1 | 3/2021 | Ornelaz et al. |
| 2021/0140255 | A1 | 5/2021 | Greci et al. |
| 2021/0189817 | A1 | 6/2021 | Fripp et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |

FOREIGN PATENT DOCUMENTS

| | | | |
|---|---|---|---|
| CA | 2085547 | A1 | 8/2019 |
| CA | 3085547 | A1 | 8/2019 |
| CN | 1708631 | A | 12/2005 |
| CN | 102027189 | A | 4/2011 |
| CN | 104583530 | A | 4/2015 |
| CN | 105422146 | A | 3/2016 |
| CN | 106522923 | A | 3/2017 |
| CN | 107148444 | A | 9/2017 |
| CN | 107250321 | A | 10/2017 |
| CN | 107532466 | A | 1/2018 |
| EP | 2399000 | A2 | 12/2011 |
| EP | 2217790 | B1 | 10/2016 |
| EP | 2753791 | B1 | 6/2017 |
| FR | 3073549 | A1 | 5/2019 |
| GB | 2381278 | A | 4/2003 |
| GB | 2416796 | A | 2/2006 |
| GB | 2469723 | A | 10/2010 |
| GB | 2514195 | B | 6/2019 |
| GB | 2583232 | A | 10/2020 |
| GB | 2557397 | B | 8/2021 |
| GB | 2600258 | | 4/2022 |
| MX | 2011008597 | A | 9/2011 |
| RU | 2424419 | C1 | 7/2011 |
| RU | 2588501 | C2 | 6/2016 |
| RU | 182236 | U1 | 8/2018 |
| WO | 0026501 | A1 | 5/2000 |
| WO | 2008079486 | A1 | 7/2008 |
| WO | 2010096417 | A2 | 8/2010 |
| WO | 2012090056 | A2 | 7/2012 |
| WO | 2013033208 | | 3/2013 |
| WO | 2014098885 | A1 | 6/2014 |
| WO | 2014110382 | A1 | 7/2014 |
| WO | 2014210283 | A1 | 12/2014 |
| WO | 2016081287 | A1 | 5/2016 |
| WO | 2016171666 | A1 | 10/2016 |
| WO | 2018005740 | A1 | 1/2018 |
| WO | 2018057361 | A1 | 3/2018 |
| WO | 2018085102 | A1 | 5/2018 |
| WO | 2018102196 | A1 | 6/2018 |
| WO | 2018147833 | A1 | 8/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |
| WO | 2020068037 | A1 | 4/2020 |
| WO | 2021021203 | A1 | 2/2021 |
| WO | 2021076141 | A1 | 4/2021 |

OTHER PUBLICATIONS

Dutch Search Report issued in related NL 2026737, dated Aug. 13, 2021.
International Search Report & Written Opinion in PCT/US2020/065539, dated Aug. 30, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report dated Dec. 17, 2021; CN Application No. 2018800875885.
Examination Report in GB Appln No. 2010931.0 dated, Jan. 18, 2022.
International Search Report & Written Opinion in PCT/US2019/058904, dated Jul. 23, 2020.
Netherlands Search Report in Application No. 2025954, dated Mar. 2, 2021.
International Search Report and Written Opinion in PCT/US2019/044542, dated Apr. 28, 2020.
Examination Report in GCC Application No. GC 2020-40201, dated Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 dated Jan. 10, 2022.
International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GC Application No. 2019-38908, dated Nov. 4, 2020.
GC Examination Report in GC Application No. 2020-40475, dated Nov. 25, 2021.
MY Search Report in MY Application No. PI2020003430, dated May 26, 2022.
GB Examination Report in Application No. 2010931.0 dated Apr. 5, 2022.
DK Examination Report in Application No. PA 202070389, dated Oct. 20, 2021.
International Search Report and Written Opinion dated Aug. 2, 2018, International PCT Application No. PCT/US2017/061307.
Search Report in FR Application No. 1859379, dated Oct. 15, 2019.
International Search Report and Written Opinion dated Nov. 19, 2018; International PCT Application No. PCT/US2018/019337.
Denmark Examination Report and Search Report dated Mar. 16, 2021, Denmark Application No. PA202070389.
International Search Report and Written Opinion dated Jul. 8, 2020, issued in related International Application No. PCT/US2019/056814.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
NEMISIS Annulus Swellable Packer, Weatherford, Swellable Products, 2009-2011.

(56) References Cited

OTHER PUBLICATIONS

International Search Report and Written Opinion dated Nov. 22, 2019; International Application No. PCT/US2019/019210, 11 pages.
International Search Report and Written Opinion dated May 20, 2020; international Application No. PCT/US2019/047529, 12 pages.
International Search Report and Written Opinion dated Sep. 8, 2021; International Application No. PCT/US2020/066193, 12 pages.
International Preliminary Report on Patentability in PCT/US2019/068493, dated Jun. 30, 2022, 7 pages.
International Preliminary Report on Patentability in PCT/US2019/068497, dated Jun. 30, 2022, 8 pages.
International Preliminary Report on Patentability in PCT/US2019/019210, dated Aug. 24, 2021, 6 pages.
International Preliminary Report on Patentability in PCT/US2019/058904, dated May 3, 2022, 8 pages.
Office Action in CA Appin No. 3,070,929 dated Jul. 9, 2021, 6 pages.
Examination Report in GCC Application No. GC 2020-39914, dated Jul. 29, 2021, 4 pages.
Dutch Search Report issued in NL 2026726, dated Aug. 13, 2021, 7 pages.
Search Report and Written Opinion issued in NL 2026329, dated Aug. 13, 2021, 8 pages.
Written Opinion and Search Report in SG Application No. 11202000316S, dated Aug. 30, 2021, 7 pages.
Fripp, Michael, et al., "Novel Expanding Metal Alloy for Non-Elastomeric Sealing and Anchoring," Research Paper, Oct. 3, 2022, 8 pages, Society of Petroleum Engineers, SPE-210273-MS, USA.
Tao, Li, "Solid expandable tubular patching technique for high-temperature and high-pressure casing damaged wells," Research Paper, Jun. 2015, pp. 408-413, Petroleum Exploration and Development, vol. 42, Issue 3, Elsevier BV.
International Preliminary Report on Patentability in PCT/US2019/056814, dated Apr. 19, 2022, 7 pages.
International Search Report and Written Opinion dated Feb. 10, 2021; International Application No. PCT/US2020/034887.
Written Opinion and Search Report in SG Application No. 11202112174W, dated Jul. 24, 2023.
First Examination Report in SA Application No. 522441072 dated May 29, 2023.

* cited by examiner

REACTIVE METAL SEALING ELEMENTS FOR A LINER HANGER

TECHNICAL FIELD

The present disclosure relates to the use of reactive metal sealing elements, and more particularly, to the use of reactive metal sealing elements for sealing and anchoring liner hangers and tie-back liners in wellbore applications.

BACKGROUND

In some wellbore operations, a liner may be suspended from a casing string or set cement layer with a liner hanger. The liner hanger anchors to the interior of the casing string or set cement layer and suspends the liner below the casing string or set cement layer. The suspended liner and the liner hanger do not extend to the surface as a casing string or set cement layer may. A liner hanger forms a seal with the casing string or set cement layer to prevent fluid flow therein from outside of the suspended liner. The fluid flow may thus be directed through the liner instead. In some wellbore operations, a tie-back liner may be sealed to the liner hanger. The tie-back liner runs back to the surface and may or not be installed permanently by cementing it in place.

Sealing elements may be used for a variety of wellbore applications including forming annular seals in and around liner hangers and tie-back liners. The annular seal may restrict all or a portion of fluid and/or pressure communication at the seal interface. These sealing elements may seal and anchor the liner hangers and tie-back liners to the adjacent surface such as the casing, set cement layer, or to the liner hanger in the case of tie-back liners. Some species of sealing elements comprise swellable materials that may swell if contacted with specific swell-inducing fluid.

Many species of the aforementioned swellable materials comprise elastomers. Elastomers, such as rubber, swell when contacted with a swell-inducing fluid. The swell-inducing fluid may diffuse into the elastomer where a portion may be retained within the internal structure of the elastomer. Swellable materials such as elastomers may be limited to use in specific wellbore environments (e.g., those without high salinity and/or high temperatures). The present disclosure provides improved apparatus and methods for forming seals in wellbore applications.

BRIEF DESCRIPTION OF THE DRAWINGS

Illustrative examples of the present disclosure are described in detail below with reference to the attached drawing figures, which are incorporated by reference herein, and wherein.

Figure 1:
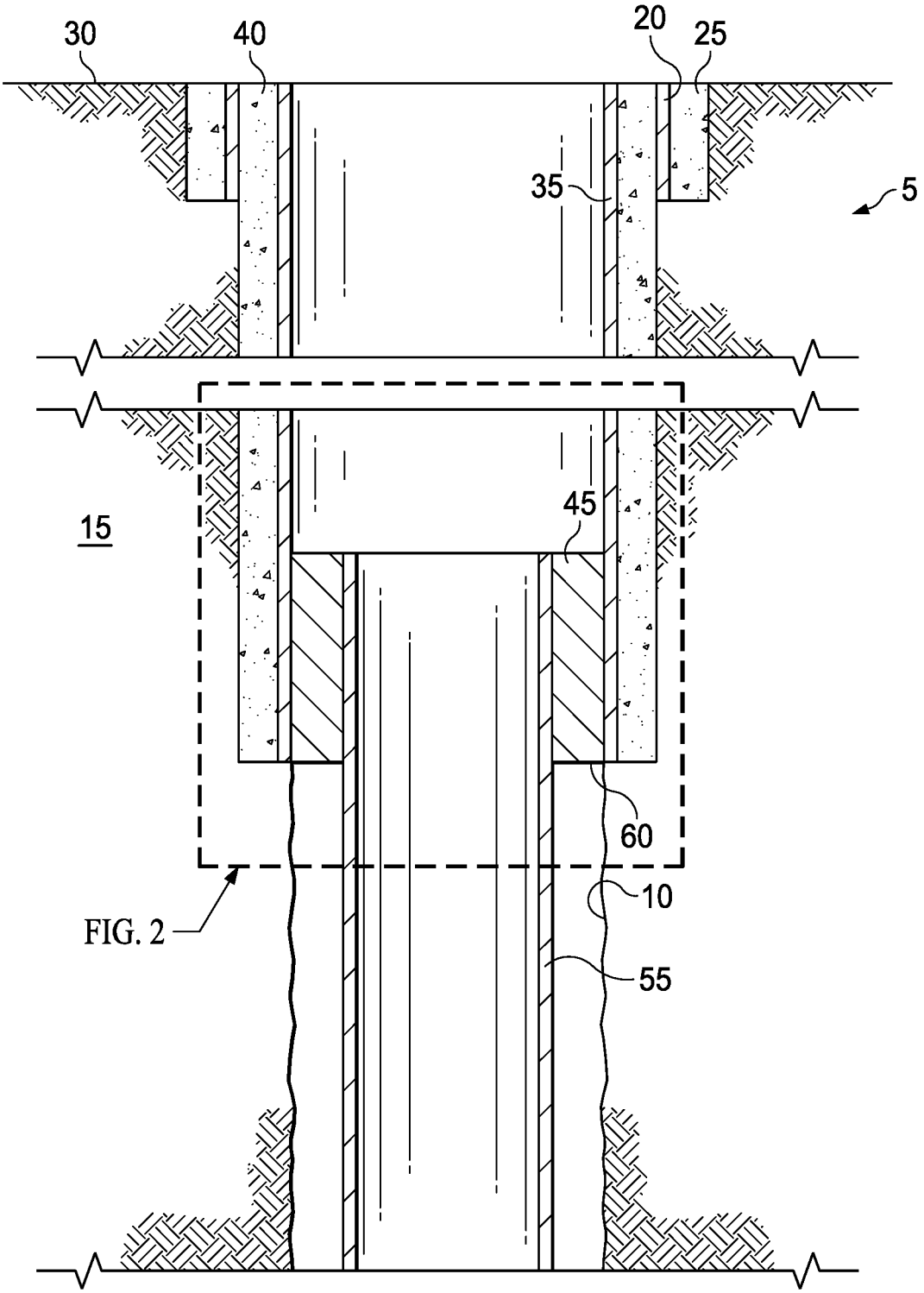
FIG. 1 is a cross-section illustrating an example tubing system for a wellbore penetrating a subterranean formation in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to the use of reactive metal sealing elements, and more particularly, to the use of reactive metal sealing elements for sealing and anchoring liner hangers and tie-back liners in wellbore applications.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to the use of reactive metal sealing elements comprising reactive metals. As used herein, "sealing elements" refers to any element used to form a seal. A "seal" is a barrier to the passage of a liquid and/or gas. In some examples, the metal sealing elements described herein may form a seal that complies with the International Organization for Standardization (ISO) 14310:2001/API Specification 11D1 1$^{st}$ Edition validation standard for the Grade V5: Liquid Test. The reactive metals expand by contacting specific reaction-inducing fluids to produce a reaction product having a larger volume than the base reactive metal reactant. The increase in metal volume of the reaction product creates a seal at the interface of the reactive metal sealing element and any adjacent surface. By "expand," "expanding," or "expandable" it is meant that the reactive metal sealing element increases its volume as the reactive metal reacts with a reaction-inducing fluid, such as a brine, thereby inducing the formation of the reaction products. Formation of the reaction products results in the volumetric expansion of the reactive metal sealing element. Advantageously, the reactive metal sealing elements may be used in a variety of wellbore applications where an irreversible seal is desired. Yet a further advantage is that the reactive metal sealing elements may swell in high-salinity and/or high-temperature environments that may be unsuitable for some other species of sealing elements. An additional advantage is that the reactive metal sealing elements comprise a wide variety of metals and metal alloys and may expand upon contact with reaction-inducing fluids, including a variety of wellbore fluids. The reactive metal sealing elements may be used as replacements for other types of sealing elements (e.g., elastomeric sealing elements), or they may be used as backups for other types of sealing elements. One other advantage is that the reactive metal sealing elements may be placed on an existing liner hanger or tie-back liner without impact to or adjustment of the liner hanger or tie-back liner's outer diameter or exterior profile. Another advantage is that the reactive metal sealing elements may be used on a variety of liner hangers including expandable, non-expandable, and drop-off species.

The reactive metals expand by undergoing a reaction in the presence of a reaction-inducing fluid (e.g., a brine) to form a reaction product (e.g., metal hydroxides). The resulting reaction products occupy more volumetric space relative to the base reactive metal reactant. This difference in volume allows the reactive metal sealing element to form a seal at the interface of the reactive metal sealing element and any adjacent surfaces. Magnesium may be used to illustrate the volumetric expansion of the reactive metal as it undergoes reaction with the reaction-inducing fluid. A mole of magnesium has a molar mass of 24 g/mol and a density of 1.74 g/cm$^3$, resulting in a volume of 13.8 cm$^3$/mol. Magnesium hydroxide, the reaction product of magnesium and an aqueous reaction-inducing fluid, has a molar mass of 60 g/mol and a density of 2.34 g/cm$^3$, resulting in a volume of 25.6 cm$^3$/mol. The magnesium hydroxide volume of 25.6 cm$^3$/mol is an 85% increase in volume over the 13.8 cm$^3$/mol volume of the mole of magnesium. As another example, a mole of calcium has a molar mass of 40 g/mol and a density of 1.54 g/cm$^3$, resulting in a volume of 26.0 cm$^3$/mol. Calcium hydroxide, the reaction product of calcium and an aqueous reaction-inducing fluid, has a molar mass of 76 g/mol and a density of 2.21 g/cm$^3$, resulting in a volume of 34.4 cm$^3$/mol. The calcium hydroxide volume of 34.4 cm$^3$/mol is a 32% increase in volume over the 26.0 cm$^3$/mol volume of the mole of calcium. As yet another example, a mole of aluminum has a molar mass of 27 g/mol and a density of 2.7 g/cm$^3$, resulting in a volume of 10.0 cm$^3$/mol. Aluminum hydroxide, the reaction product of aluminum and an aqueous reaction-inducing fluid, has a molar mass of 63 g/mol and a density of 2.42 g/cm$^3$ resulting in a volume of 26 cm$^3$/mol. The aluminum hydroxide volume of 26 cm$^3$/mol is a 160% increase in volume over the 10 cm$^3$/mol volume of the mole of aluminum. The reactive metal may comprise any metal or metal alloy that undergoes a reaction to form a reaction product having a greater volume than the base reactive metal or alloy reactant.

Examples of suitable metals for the reactive metal include, but are not limited to, magnesium, calcium, aluminum, tin, zinc, beryllium, barium, manganese, or any combination thereof. Preferred metals include magnesium, calcium, and aluminum.

Examples of suitable metal alloys for the reactive metal include, but are not limited to, alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increases hydroxide formation. Examples of dopant metals include, but are not limited to nickel, iron, copper, carbon, titanium, gallium, mercury, cobalt, iridium, gold, palladium, or any combination thereof.

In some examples, the reactive metal comprises an oxide. As an example, calcium oxide reacts with water in an energetic reaction to produce calcium hydroxide. One mole of calcium oxide occupies 9.5 cm$^3$ whereas one mole of calcium hydroxide occupies 34.4 cm$^3$. This is a 260% volumetric expansion of the mole of calcium oxide relative to the mole of calcium hydroxide. Examples of metal oxides suitable for the reactive metal may include, but are not limited to, oxides of any metals disclosed herein, including magnesium, calcium, aluminum, iron, nickel, copper, chromium, tin, zinc, lead, beryllium, barium, gallium, indium, bismuth, titanium, manganese, cobalt, or any combination thereof.

It is to be understood that the selected reactive metal is chosen such that the formed reactive metal sealing element does not dissolve or otherwise degrade in the reaction-inducing fluid. As such, the use of metals or metal alloys for the reactive metal that form relatively insoluble reaction products in the reaction-inducing fluid may be preferred. As an example, the magnesium hydroxide and calcium hydroxide reaction products have very low solubility in water. As an alternative or an addition, the reactive metal sealing element may be positioned and configured in a way that constrains the degradation of the reactive metal sealing element in the reaction-inducing fluid due to the geometry of the area in which the reactive metal sealing element is disposed. This may result in reduced exposure of the reactive metal sealing element to the reaction-inducing fluid, but may also reduce degradation of the reaction product of the reactive metal sealing element, thereby prolonging the life of the formed seal. As an example, the volume of the area in which the sealing element is disposed may be less than the potential expansion volume of the volume of reactive metal disposed in said area. In some examples, this volume of area may be less than as much as 50% of the expansion volume of reactive metal. Alternatively, this volume of area may be less than 90% of the expansion volume of reactive metal. As another alternative, this volume of area may be less than 80% of the expansion volume of reactive metal. As another alternative, this volume of area may be less than 70% of the expansion volume of reactive metal. As another alternative, this volume of area may be less than 60% of the expansion volume of reactive metal. In a specific example, a portion of the reactive metal sealing element may be disposed in a recess within the conduit body of the liner hanger or tie-back liner to restrict the exposure area to only the surface portion of the reactive metal sealing element that is not disposed in the recess.

In some examples, the formed reaction products of the reactive metal reaction may be dehydrated under sufficient pressure. For example, if a metal hydroxide is under sufficient contact pressure and resists further movement induced by additional hydroxide formation, the elevated pressure may induce dehydration of the metal hydroxide to form the metal oxide. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water.

The reactive metal sealing elements may be formed in a solid solution process, a powder metallurgy process, or through any other method as would be apparent to one of ordinary skill in the art. Regardless of the method of manufacture, the reactive metal sealing elements may be slipped over the liner hanger mandrel or tie-back liner mandrel and held in place via any sufficient method. The pressure reducing metal element may be placed over the mandrel in one solid piece or in multiple discrete pieces. Once in place, the reactive metal sealing element is held in position with end rings, stamped rings, retaining rings, fasteners, adhesives, set screws, or any other such method for retaining the reactive metal sealing element in position. As discussed above, the reactive metal sealing elements may be formed and shaped to fit over existing liner hangers and tie-back liners and thus may not require modification of the outer diameter or profile of the liner hanger or tie-back liner. Alternatively, the liner hanger or tie-back liner may be manufactured to comprise a recess in which the reactive metal sealing element may be disposed. The recess may be of sufficient dimensions and geometry to retain the reactive metal sealing elements in the recess. In alternative examples, the reactive metal sealing element may be cast onto the conduit body of the liner hanger or tie-back liner. In some alternative examples, the diameter of the reactive metal sealing element may be reduced (e.g., by swaging) when disposed on the conduit body of the liner hanger or tie-back liner.

In some optional examples, the reactive metal sealing element may include a removable barrier coating. The removable barrier coating may be used to cover the exterior surfaces of the sealing element and prevent contact of the reactive metal with the reaction-inducing fluid. The removable barrier coating may be removed when the sealing operation is to commence. The removable barrier coating may be used to delay sealing and/or prevent premature sealing with the reactive metal sealing element. Examples of the removable barrier coating include, but are not limited to, any species of plastic shell, organic shell, paint, dissolvable coatings (e.g., solid magnesium compounds), eutectic materials, or any combination thereof. When desired, the removable barrier coating may be removed from the sealing element with any sufficient method. For example, the removable barrier coating may be removed through dissolution, a phase change induced by changing temperature, corrosion, hydrolysis, or the removable barrier coating may be time-delayed and degrade after a desired time under specific wellbore conditions.

In some optional examples, the reactive metal sealing element may include an additive which may be added to the reactive metal sealing element during manufacture as a part of the composition, or the additive may be coated onto the reactive metal sealing element after manufacturing. The additive may alter one or more properties of the reactive metal sealing element. For example, the additive may improve sealing, add texturing, improve bonding, improve gripping, etc. Examples of the additive include, but are not limited to, any species of ceramic, elastomer, glass, non-reacting metal, the like, or any combination.

The reactive metal sealing element may be used to form a seal between any adjacent surfaces that are proximate to the reactive metal sealing elements. Without limitation, the reactive metal sealing elements may be used to form seals on casing, formation surfaces, cement sheaths or layers, and the like. For example, a reactive metal sealing element may be used to form a seal between the outer diameter of the liner hanger and a surface of an adjacent casing. Alternatively, the reactive metal sealing element may be used to form a seal between the outer diameter of the liner hanger and a surface of an adjacent set cement layer. As another example, a reactive metal sealing element may be used to form a seal between the outer diameter of the tie-back liner and a surface of an adjacent liner hanger. Moreover, a plurality of the reactive metal sealing elements may be used to form multiple seals between adjacent surfaces.

As described above, the reactive metal sealing elements comprise reactive metals and as such, they are non-elastomeric materials. As non-elastomeric materials, the reactive metal sealing elements do not possess elasticity, and therefore, they may irreversibly expand when contacted with a reaction-inducing fluid. The reactive metal sealing elements may not return to their original size or shape even after the reaction-inducing fluid is removed from contact.

Generally, the reaction-inducing fluid induces a reaction in the reactive metal to form a reaction product that occupies more space than the unreacted reactive metal. Examples of the reaction-inducing fluid include, but are not limited to, saltwater (e.g., water containing one or more salts dissolved therein), brine (e.g., saturated saltwater, which may be produced from subterranean formations), seawater, or any combination thereof. Generally, the reaction-inducing fluid may be from any source provided that the fluid does not contain an excess of compounds that may undesirably affect other components in the sealing element. In the case of saltwater, brines, and seawater, the reaction-inducing fluid may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reaction-inducing fluid may exceed 10%. Advantageously, the reactive metal sealing elements of the present disclosure may not be impacted by contact with high-salinity fluids. One of ordinary skill in the art, with the benefit of this disclosure, should be readily able to select a reaction-inducing fluid for inducing a reaction with the reactive metal sealing elements.

The reactive metal sealing elements may be used in high-temperature formations, for example, in formations with zones having temperatures equal to or exceeding 350° F. Advantageously, the use of the reactive metal sealing elements of the present disclosure may not be impacted in high-temperature formations. In some examples, the reactive metal sealing elements may be used in both high-temperature formations and with high-salinity fluids. In a specific example, a reactive metal sealing element may be positioned on a liner hanger and used to form a seal after contact with a brine having a salinity of 10% or greater while also being disposed in a wellbore zone having a temperature equal to or exceeding 350° F.

FIG. 1 is a cross-section of an example tubing system, generally 5, for a wellbore 10 penetrating a subterranean formation 15. The tubing system 5 comprises a surface casing 20 and a surface cement sheath 25 descending from the surface 30. The tubing system 5 further comprises an intermediate casing 35 and intermediate cement sheath 40 deployed and nested concentrically within the surface casing 20. Although only one layer of intermediate casing 35 is illustrated, it is to be understood that more than one layer of intermediate casing 35 may be deployed in any example. A liner hanger 45 is deployed within the intermediate casing 35. The liner hanger 45 may be used to suspend a liner 55 from within the intermediate casing 35. The liner 55 may be any conduit suitable for suspension within the wellbore 10. The liner hanger 45 comprises a conduit body 60. The liner 55 is a conduit that does not run to the surface 30. The liner hanger 45 seals within the intermediate casing 35 allowing the liner 55 to functionally act as an extension of the intermediate casing 35 without having to extend to the surface 30 as a separate casing string would.

Figure 2:
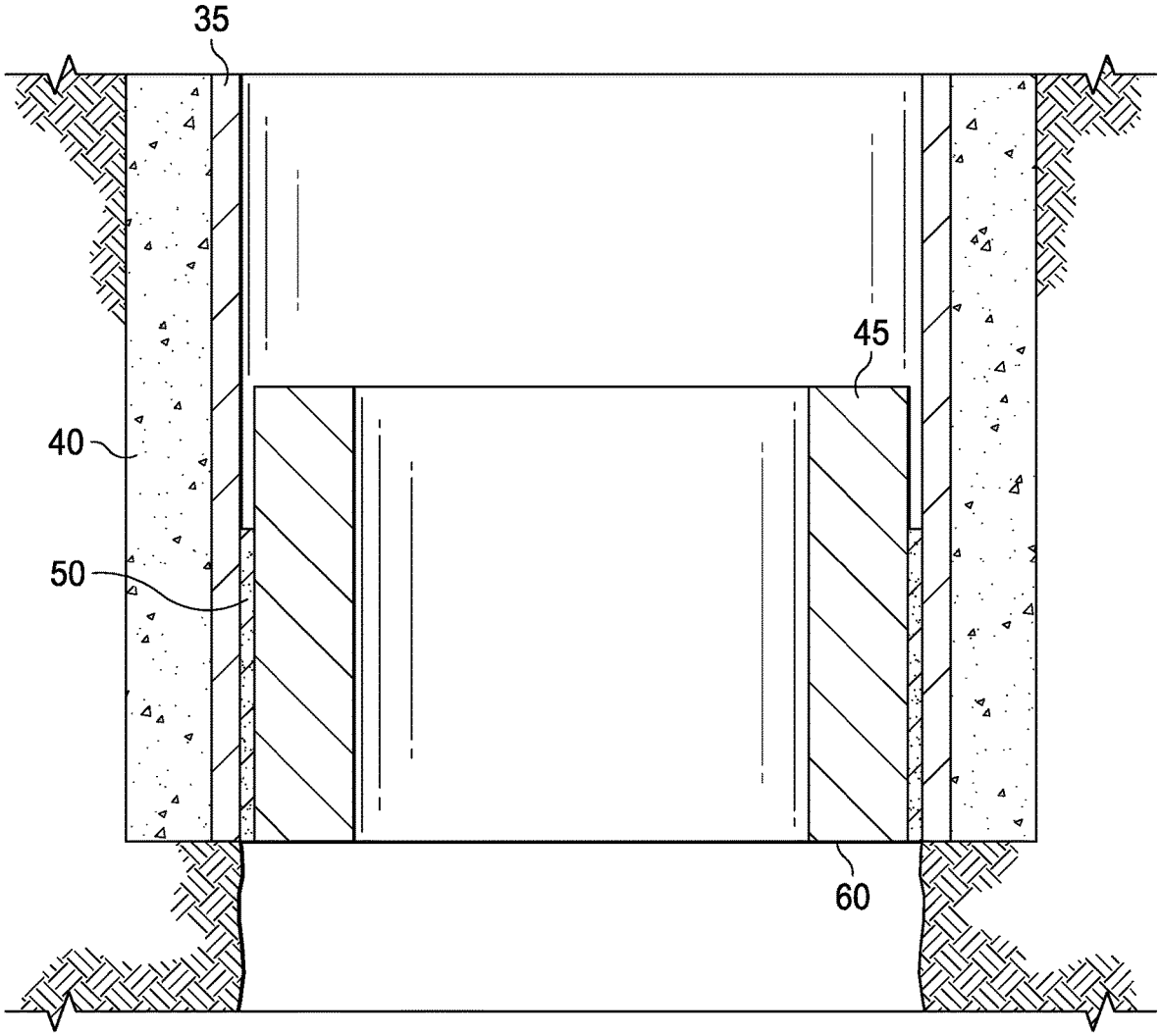
FIG. 2 is an enlarged cross-section illustrating a portion of the example tubing system of FIG. 1 in accordance with the examples disclosed herein.

FIG. 2 is an enlarged cross-section of a portion of the example tubing system 5 of FIG. 1. Intermediate casing 35 extends from the surface (i.e., surface 30 as illustrated in FIG. 1) and may be held in place with the intermediate cement sheath 40. Although only one layer of intermediate casing 35 is illustrated, it is to be understood that as many layers of intermediate casing 35 may be used as desired. Any subsequent layers of the intermediate casing 35 may be nested concentrically within one another within the illustrated intermediate casing 35. The liner hanger 45 is deployed within the intermediate casing 35. The liner hanger 45 may be any species of liner hanger and may be expandable or non-expandable. The liner hanger 45 suspends a liner (i.e., liner 55 as illustrated in FIG. 1). The liner hanger 45 is anchored to the intermediate casing 35 with a reactive metal sealing element 50 after the reactive metal sealing element 50 has reacted and expanded. The reactive metal sealing element 50 is disposed on and around the conduit body 60 of the liner hanger 45. The reactive metal sealing element 50 forms an external seal with the adjacent interior surface of the intermediate casing 35 after the reactive metal sealing element 50 has reacted and expanded. The reactive metal sealing element 50 expands after exposure to a reaction-inducing fluid. The reactive metal sealing element 50 reacts to produce the expanded metal reaction product described above. As the expanded metal reaction product has a larger volume than the unreacted expendable metal, the reactive metal sealing element 50 is able to expand and form an annular seal at the interface of the adjacent surface of the intermediate casing 35 as described above. The reactive metal sealing element 50 may continue to expand until contact with the adjacent surface is made. The formed seal prevents wellbore fluid from bypassing the liner and liner hanger 45.

It should be clearly understood that the examples illustrated by FIGS. 1-2 are merely general applications of the principles of this disclosure in practice, and a wide variety of other examples are possible. Therefore, the scope of this disclosure is not limited in any manner to the details of any of the FIGURES described herein.

Figure 3A:
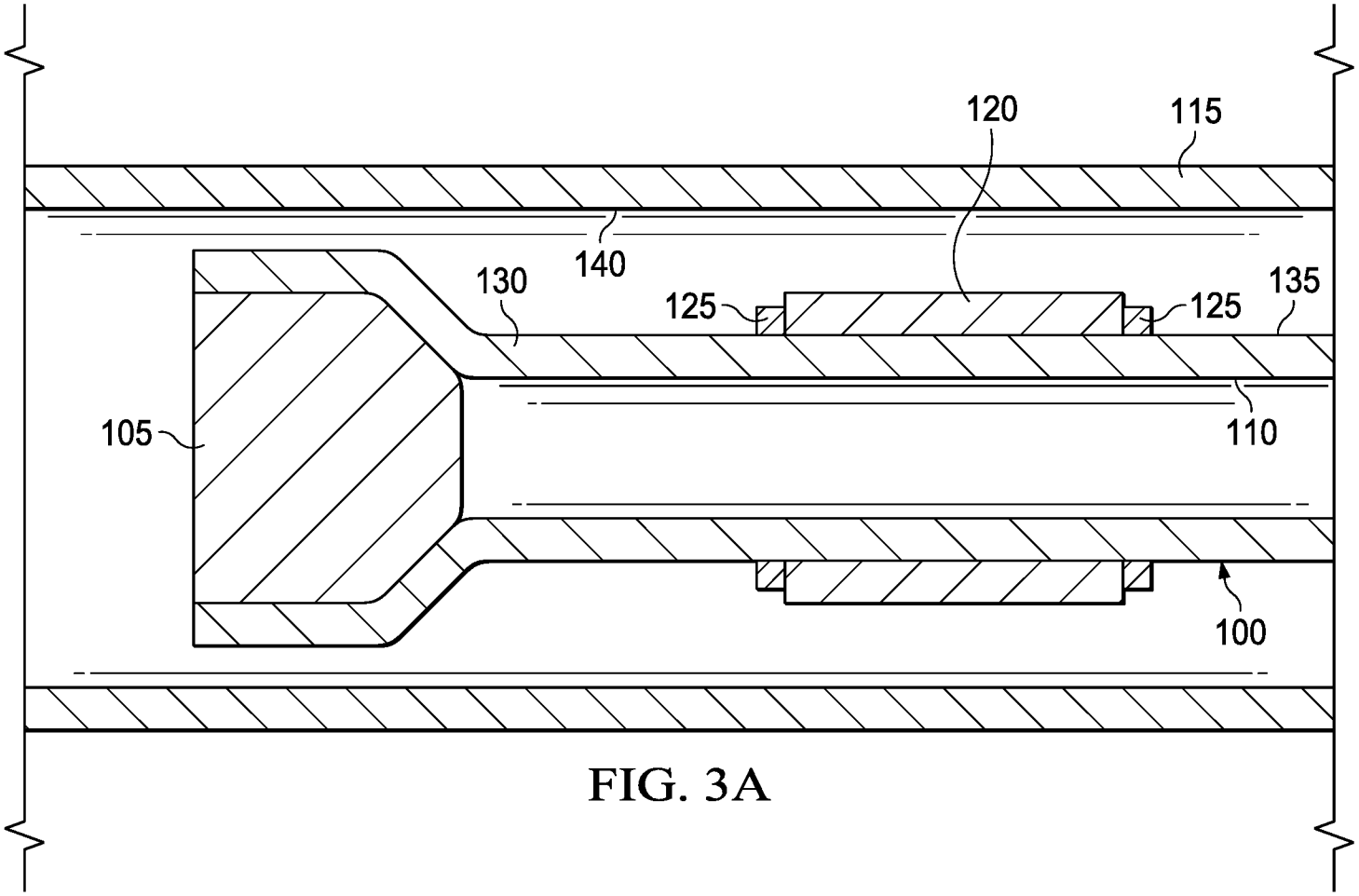
FIG. 3A is a cross-section of an expandable liner hanger in accordance with the examples disclosed herein.

FIG. 3A is a cross-section of an expandable liner hanger 100. Expandable liner hanger 100 may be deployed in a wellbore similarly to liner hanger 45 illustrated in FIGS. 1 and 2. Liner hanger 100 may be expanded to increase its diameter. An expansion cone 105 may be run through the interior of the liner hanger 100 to apply force to the interior surface 110 of the liner hanger 100. The applied force may expand the conduit body 130 of the liner hanger 100 outward increasing the outer diameter of the conduit body 130 such that at least a portion of the exterior surface 135 of the conduit body 130 may contact the interior surface 140 of an adjacent casing 115. A reactive metal sealing element 120 may be positioned around the exterior surface 135 of the liner hanger 100 and held in place with end rings 125. The end rings 125 may also protect the reactive metal sealing element 120 as it is run to depth. FIG. 3A illustrates the initiation of the expansion of the liner hanger 100.

Figure 3B:
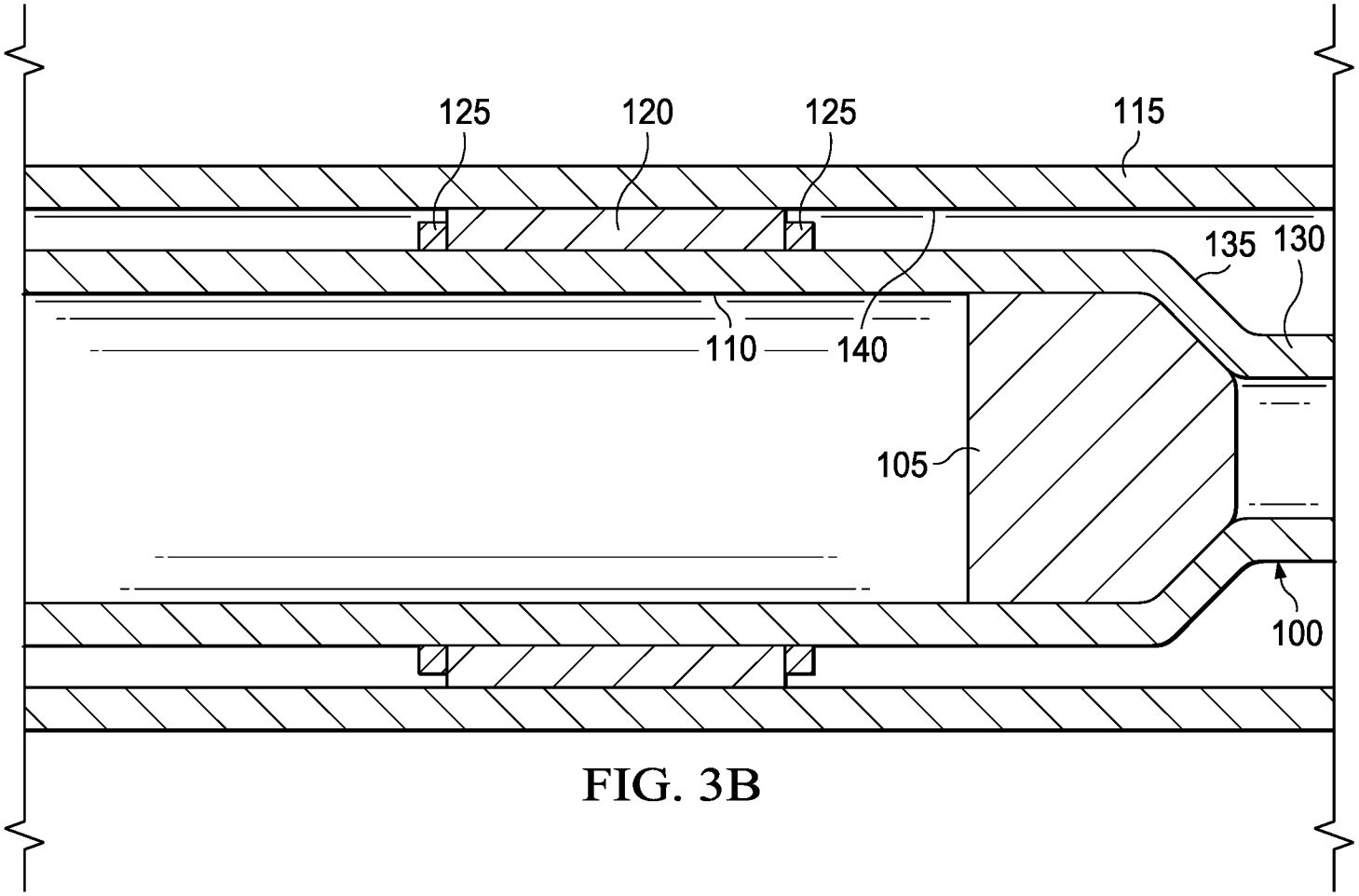
FIG. 3B is a cross-section of the expandable liner hanger of FIG. 3A after a portion of it is expanded in accordance with the examples disclosed herein.

FIG. 3B is a cross-section of an expandable liner hanger 100 after a portion of it has been expanded by the expansion cone 105. As illustrated, the reactive metal sealing element 120 may be expanded alongside the conduit body 130 of the liner hanger 100. The reactive metal sealing element 120 may be retained in its orientation after expansion by the end rings 125. After reaction with a reaction-inducing fluid, the reactive metal sealing element 120 may expand to fill any voids or irregularities in the exterior surface 135 of the conduit body 130 or the interior surface 140 of the casing 115. The expanded reactive metal sealing element 120 may seal any proximate annular space remaining between the liner hanger 100 and the casing 115 after expansion of the liner hanger 100. The end rings 125 may create an extrusion barrier, preventing the applied pressure from extruding the seal formed from the reactive metal sealing element 120 in the direction of said applied pressure. Although FIGS. 3A and 3B herein may illustrate end rings 125 as a component of the expandable liner hanger 100, it is to be understood that the end rings 125 are optional components in all examples described herein, and are not necessary for any species of liner hanger or tie-back liner described herein to function as intended. The reactive metal sealing element 120 may be held in position with other apparatus or may be positioned in a recess on the exterior surface 135 of the conduit body 130 of the liner hanger 100 to retain its position.

It should be clearly understood that the examples illustrated by FIGS. 3A-3B are merely general applications of the principles of this disclosure in practice, and a wide variety of other examples are possible. Therefore, the scope of this disclosure is not limited in any manner to the details of any of the FIGURES described herein.

Figure 4:
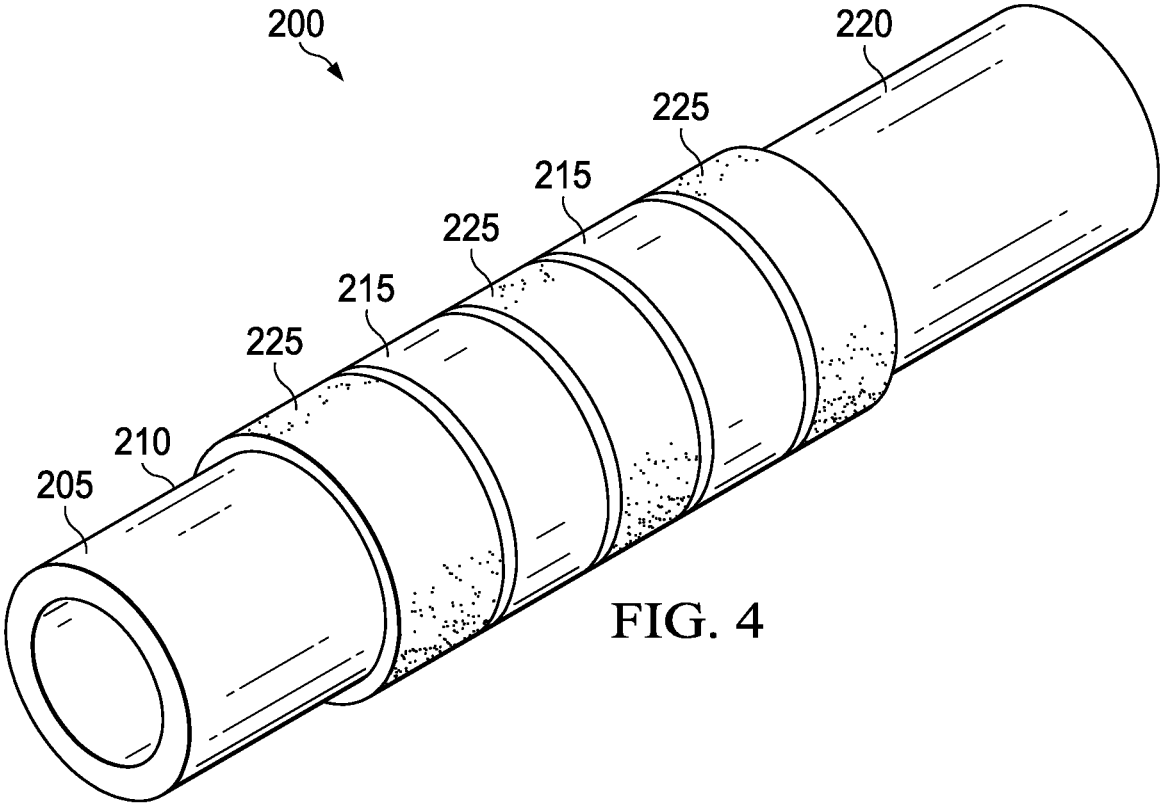
FIG. 4 is an isometric illustration of a liner hanger in accordance with the examples disclosed herein.

FIG. 4 is an isometric illustration of a liner hanger, generally 200. The liner hanger 200 couples to and forms a seal inside a casing at the coupling end 205. The liner hanger 200 comprises a conduit body 210. Reactive metal sealing elements 215 form external seals to seal against the surface of the casing and anchor the liner hanger 200 to the casing. A liner (not illustrated) may be coupled to and suspended from the suspending end 220. Elastomeric sealing elements 225 may be positioned on the ends of and in-between the reactive metal sealing elements 215 to prevent the applied pressure from extruding the seal formed from the reactive metal sealing element 215 in the direction of said applied pressure, and also to supplement the sealing of the reactive metal sealing elements 215. In some alternative examples, the elastomeric sealing elements 225 may be replaced with other species of sealing elements such as non-reactive metal sealing elements. In some other alternative examples, the elastomeric sealing elements 225 may be replaced with retaining rings as discussed above.

In the illustrated example of FIG. 4, the reactive metal sealing elements 215 and the elastomeric sealing elements 225 alternate in a series. It is to be understood that the reactive metal sealing elements 215 may be placed in any pattern or configuration-either by itself or in conjunction with other components such as other species of sealing elements or retaining elements. As an example, a single reactive metal sealing element 215 may be used. As another example, multiple reactive metal sealing elements 215 may be used. As a further example, multiple reactive metal sealing elements 215 may be used in a series adjacent one another with individual other species of sealing elements or retaining elements placed at the ends of the series. Further to this example, multiple other species of sealing elements or retaining elements may be placed at the ends of the series. As another example, the multiple reactive metal sealing elements 215 may alternate in the series with other species of sealing elements or retaining elements.

The elastomeric sealing elements 225 may be any species of swellable elastomer. The elastomeric sealing elements 225 may comprise any oil-swellable, water-swellable, and/or combination of swellable non-metal material as would occur to one of ordinary skill in the art. The swellable elastomeric sealing elements 225 may swell when exposed to a swell-inducing fluid (e.g., an oleaginous or aqueous fluid). Generally, the elastomeric sealing elements 225 may swell through diffusion whereby the swell-inducing fluid is absorbed into the structure of the elastomeric sealing elements 225 where a portion of the swell-inducing fluid may be retained. The swell-inducing fluid may continue to diffuse into elastomeric sealing elements 225, causing the elastomeric sealing elements 225 to swell until they contact an adjacent surface. The elastomeric sealing elements 225 may work in tandem with the reactive metal sealing elements 215 to create a differential annular seal around the liner hanger 200.

It should be clearly understood that the example illustrated by FIG. 4 is merely a general application of the principles of this disclosure in practice, and a wide variety of other examples are possible. Therefore, the scope of this disclosure is not limited in any manner to the details of any of the FIGURES described herein.

Figure 5:
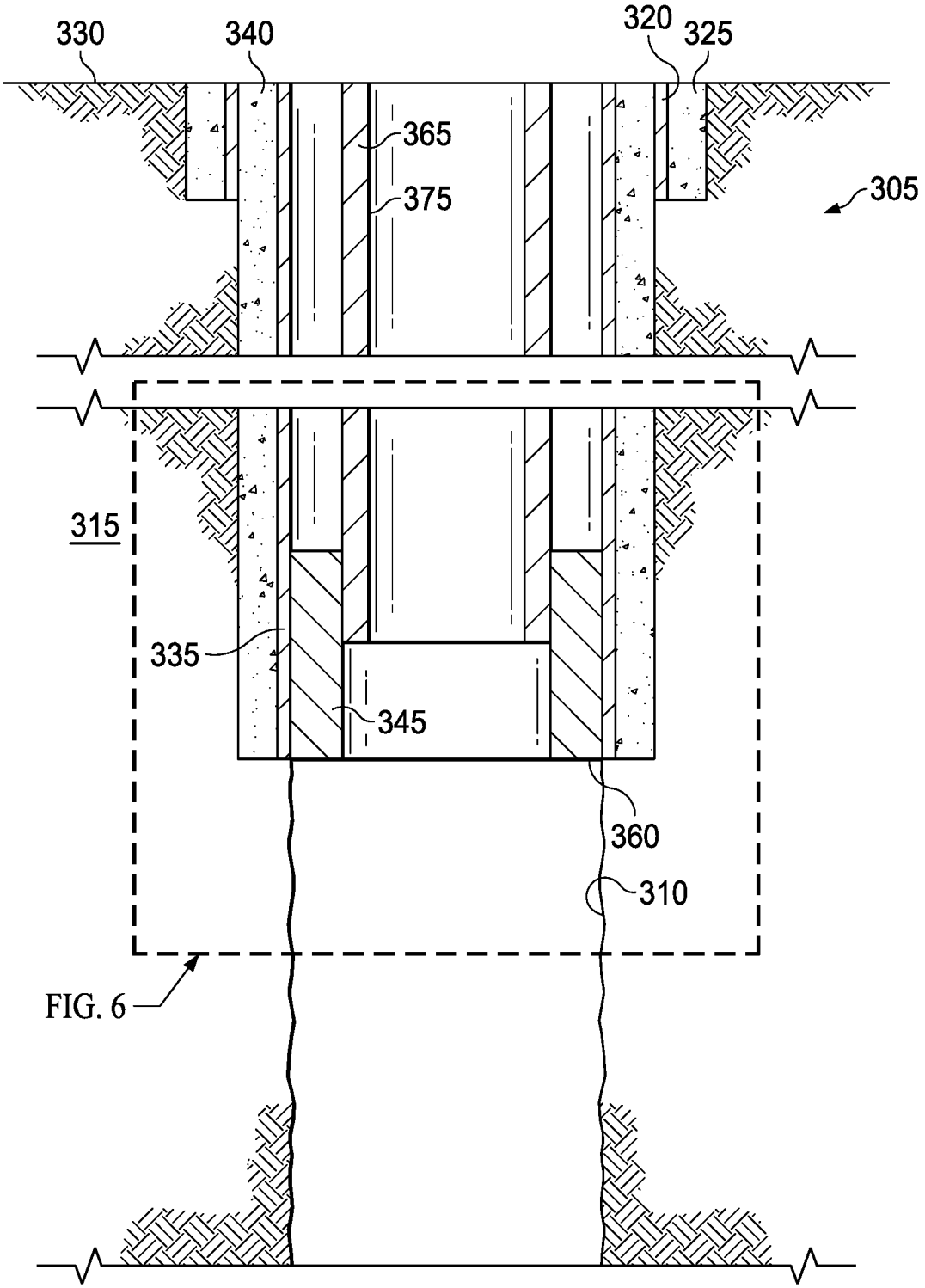
FIG. 5 is a cross-section illustrating an example tubing system for a wellbore penetrating a subterranean formation in accordance with the examples disclosed herein.

FIG. 5 is a cross-section of an example tubing system, generally 305, for a wellbore 310 penetrating a subterranean formation 315. The tubing system 305 comprises a surface casing 320 and a surface cement sheath 325 descending from the surface 330. Tubing system 305 further comprises an intermediate casing 335 and intermediate cement sheath 340 deployed and nested concentrically within the surface casing 320. Although only one layer of intermediate casing 335 is illustrated, it is to be understood that more than one layer of intermediate casing 335 may be deployed in any example. A liner hanger 345 is deployed within the intermediate casing 335. The liner hanger 345 may be used to suspend a liner (not illustrated for clarity) from within the intermediate casing 335. The liner hanger 345 comprises a conduit body 360. The liner hanger 345 seals within the intermediate casing 335. A tie-back liner 365 is coupled to the liner hanger 345. The tie-back liner comprises a conduit body 375. The tie-back liner 365 runs to the surface 330. The tie-back liner 365 may be a temporary or permanent component of the tubing system 305. If the tie-back liner 365 is to be permanent, it may be cemented into place.

Figure 6:
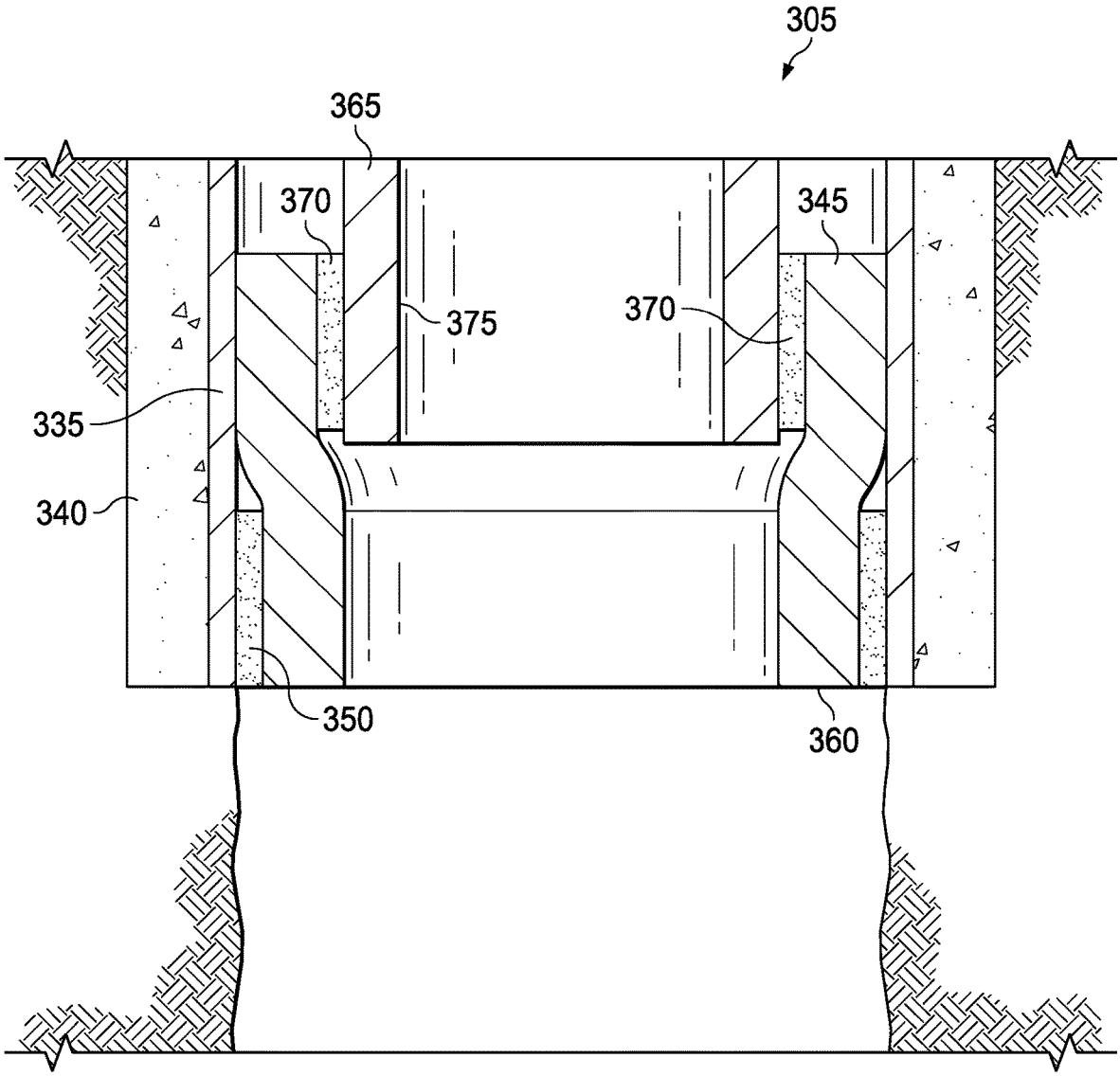
FIG. 6 is an enlarged cross-section illustrating a portion of the example tubing system of FIG. 5 in accordance with the examples disclosed herein.

FIG. 6 is an enlarged cross-section illustration of a portion of the example tubing system 305 of FIG. 5. Intermediate casing 335 extends from the surface (i.e., surface 330 as illustrated in FIG. 5) and may be held in place with the intermediate cement sheath 340. Although only one layer of intermediate casing 335 is illustrated, it is to be understood that as many layers of intermediate casing 335 may be used as desired. Any subsequent layers of the intermediate casing 335 may be nested concentrically within one another within the illustrated intermediate casing 335. The liner hanger 345 is deployed within the intermediate casing 335. The liner hanger 345 may be any species of liner hanger and may be expandable or non-expandable. The liner hanger 345 suspends a liner (not illustrated). The liner hanger 345 is anchored to the intermediate casing 335 with a reactive metal sealing element 350 after the reactive metal sealing element 350 has reacted and expanded. The reactive metal sealing element 350 is disposed on and around the conduit body 360 of the liner hanger 345. The reactive metal sealing element 350 forms an external seal with the adjacent interior surface of the intermediate casing 335 after the reactive metal sealing element 350 has reacted and expanded.

Tie-back liner 365 is deployed within the interior of the intermediate casing 335. The tie-back liner 365 may be any species of tie-back liner. The tie-back liner 365 extends to the surface (not illustrated). The tie-back liner 365 is anchored to the liner hanger 345 with a reactive metal sealing element 370 after the reactive metal sealing element 370 has reacted and expanded. The reactive metal sealing element 370 is disposed on and around the conduit body 375 of the tie-back liner 365. The reactive metal sealing element 370 forms an external seal with the adjacent interior surface of the liner hanger 345 after the reactive metal sealing element 370 has reacted and expanded.

The reactive metal sealing elements 350 and 370 expand after exposure to a reaction-inducing fluid. The reactive metal sealing elements 350 and 370 react to produce an expanded metal reaction product described above. As the expanded metal reaction product has a larger volume than the unreacted expendable metal, the reactive metal sealing elements 350 and 370 are able to expand and form an annular seal at the interface of the adjacent surface of the intermediate casing 335 or the liner hanger 345 as described above. The reactive metal sealing elements 350 and 370 may continue to expand until contact with the adjacent surface is made. The formed seal prevents wellbore fluid from bypassing the liner and liner hanger 345 or the tie-back liner 365.

It should be clearly understood that the examples illustrated by FIGS. 5-6 are merely general applications of the principles of this disclosure in practice, and a wide variety of other examples are possible. Therefore, the scope of this disclosure is not limited in any manner to the details of any of the FIGURES described herein.

Figure 7A:
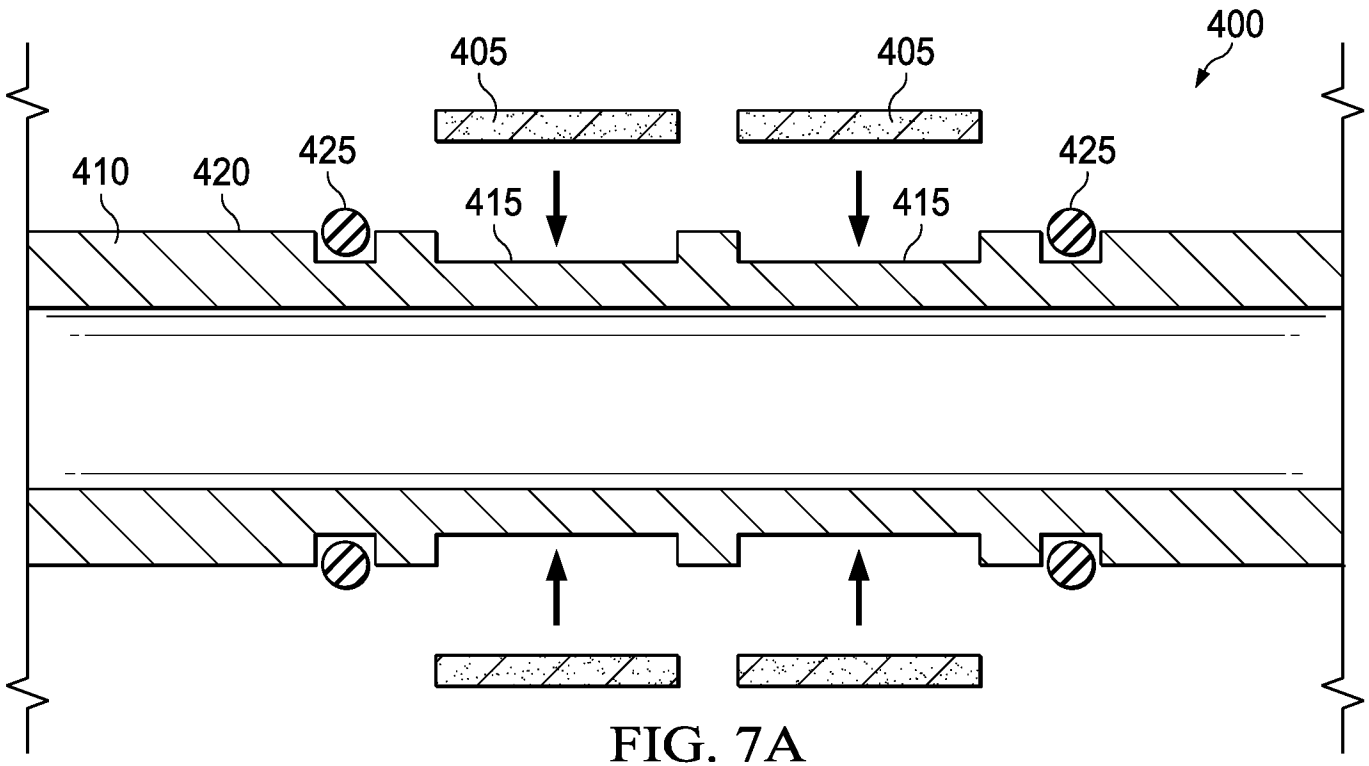
FIG. 7A is a cross-section illustration of a tie-back liner in the process of being fitted with a reactive metal sealing element in accordance with the examples disclosed herein.

FIG. 7A is a cross-section of a tie-back liner 400 illustrating the coupling of the tie-back liner 400 with a reactive metal sealing element 405. The tie-back liner 400 may be deployed in a wellbore similarly to the tie-back liner 365 illustrated in FIGS. 5-6. The tie-back liner 400 may comprise one or more reactive metal sealing elements 405 for sealing and anchoring to a liner hanger. The reactive metal sealing elements may be slid over the conduit body 410 of the tie-back liner 400. The reactive metal sealing elements 405 may be positioned in a recess 415 within the exterior surface 420 of the conduit body 410. Alternatively, the reactive metal sealing elements 405 may be cast onto the conduit body 410. Elastomeric sealing elements 425, or other species of sealing elements, may also be disposed on the exterior surface 420 of the conduit body 410.

Figure 7B:
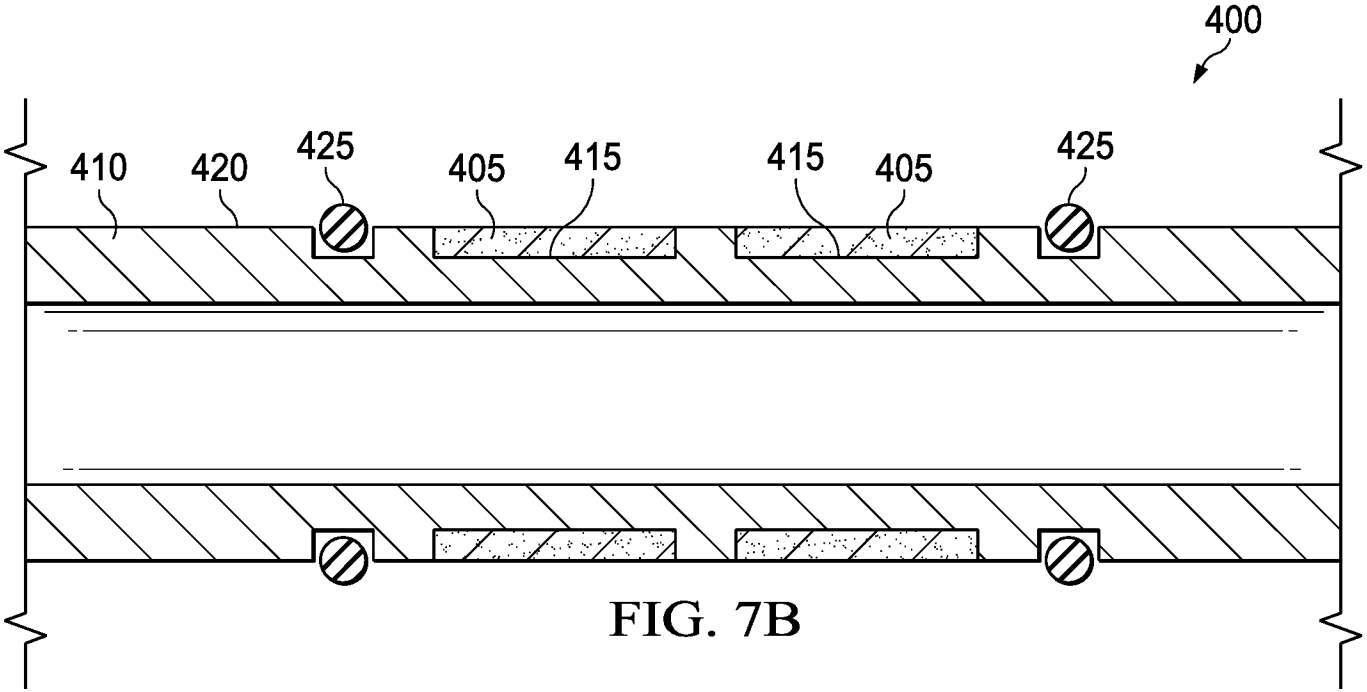
FIG. 7B is a cross-section illustration of a tie-back liner having a reactive metal sealing element fitted and swaged thereon in accordance with the examples disclosed herein.

FIG. 7B is a cross-section of a tie-back liner 400 illustrating a reactive metal sealing element 405 fitted and swaged thereon. When the one or more reactive metal sealing elements 405 are positioned in the recesses 415, the diameter of the reactive metal sealing elements 405 may be reduced as desired. The reactive metal sealing elements 405 may be swaged down to a desired diameter such that the run-in-hole configuration of the tie-back liner 400 may not be impacted. Although the reactive metal sealing elements 405 are illustrated as being level with the exterior surface 420 of the conduit body 410, it is to be understood that the reactive metal sealing elements 405 may not be level with the exterior surface 420 and may extend out of or be reduced into the recess 415 as much as desired.

In the illustrated examples of FIGS. 7A and 7B, the reactive metal sealing elements 405 are disposed between the elastomeric sealing elements 425. It is to be understood that the reactive metal sealing elements 405 may be placed in any pattern or configuration either alone or in conjunction with other components such as other species of sealing elements or retaining elements. As an example, a single reactive metal sealing element 405 may be used. As another example, multiple reactive metal sealing elements 405 may be used. As a further example, multiple reactive metal sealing elements 405 may be used in a series adjacent one another with individual other species of sealing elements or retaining elements placed at the ends of the series. Further to this example, multiple other species of sealing elements or retaining elements may be placed at the ends of the series. As another example, the multiple reactive metal sealing elements 405 may alternate in the series with other species of sealing elements or retaining elements.

The elastomeric sealing elements 425 may be any species of swellable elastomer. The elastomeric sealing elements 425 may comprise any oil-swellable, water-swellable, and/or combination of swellable non-metal material as would occur to one of ordinary skill in the art. The swellable elastomeric sealing elements 425 may swell when exposed to a swell-inducing fluid (e.g., an oleaginous or aqueous fluid). Generally, the elastomeric sealing elements 425 may swell through diffusion whereby the swell-inducing fluid is absorbed into the structure of the elastomeric sealing elements 425 where a portion of the swell-inducing fluid may be retained. The swell-inducing fluid may continue to diffuse into elastomeric sealing elements 425 causing the elastomeric sealing elements 425 to swell until they contact an adjacent surface. The elastomeric sealing elements 425 may work in tandem with the reactive metal sealing elements 405 to create a differential annular seal around the tie-back liner 400.

It should be clearly understood that the examples illustrated by FIGS. 7A-7B are merely general applications of the principles of this disclosure in practice, and a wide variety of other examples are possible. Therefore, the scope of this disclosure is not limited in any manner to the details of any of the FIGURES described herein.

It is also to be recognized that the disclosed reactive metal sealing elements may also directly or indirectly affect the various downhole equipment and tools that may come into contact with the reactive metal sealing elements during operation. Such equipment and tools may include, but are not limited to: wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are conduits for a wellbore in accordance with the disclosure and the illustrated FIGURES. An example conduit comprises a conduit body; and a reactive metal sealing element disposed on the conduit body; wherein the reactive metal sealing element comprises a reactive metal. The conduit may be a liner hanger or a tie-back liner.

Additionally or alternatively, the apparatus may include one or more of the following features individually or in combination. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof. If the conduit is the liner hanger, the liner hanger may be expandable. If the conduit is the liner hanger, the liner hanger may be non-expandable. The reactive metal sealing element may further comprise a removable barrier coating. The conduit body may comprise a recess, and the reactive metal sealing element may be disposed in the recess.

Provided are methods for treating a wellbore in accordance with the disclosure and the illustrated FIGURES. An example method comprises positioning a conduit in the wellbore; wherein the conduit is a liner hanger or a tie-back liner; and wherein the conduit comprises: a conduit body; and a reactive metal sealing element disposed on the conduit body; wherein the reactive metal sealing element comprises a reactive metal having a first volume. The method further comprises contacting the reactive metal with a fluid that reacts with the reactive metal to produce a reaction product having a second volume greater than the first volume; and contacting a surface adjacent to the reactive metal sealing element with the reaction product.

Additionally or alternatively, the method may include one or more of the following features individually or in combination. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof. If the conduit is the liner hanger, the liner hanger may be expandable. If the conduit is the liner hanger, the liner hanger may be non-expandable. If the conduit is the liner hanger, the adjacent surface may be a casing. If the conduit is the tie-back liner; the adjacent surface may be an exterior surface of a liner hanger. The reactive metal sealing element may further comprise a removable barrier coating. The conduit body may comprise a recess, and the reactive metal sealing element may be disposed in the recess. The contacting a surface adjacent to the reactive metal sealing element with the reaction product may further comprise forming a seal against the adjacent surface. The contacting a surface adjacent to the reactive metal sealing element with the reaction product may further comprise anchoring the conduit to the adjacent surface.

Provided are systems for forming a seal in a wellbore in accordance with the disclosure and the illustrated FIGURES. An example system comprises a conduit comprising: a conduit body; and a reactive metal sealing element disposed on the conduit body; wherein the reactive metal sealing element comprises a reactive metal. The conduit is a liner hanger or a tie-back liner. The system further comprises a liner.

Additionally or alternatively, the system may include one or more of the following features individually or in combination. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof. If the conduit is the liner hanger, the liner hanger may be expandable. If the conduit is the liner hanger, the liner hanger may be non-expandable. The reactive metal sealing element may further comprise a removable barrier coating. The conduit body may comprise a recess, and the reactive metal sealing element may be disposed in the recess. If the conduit is the liner hanger, the system may further comprise a casing and the liner hanger may be sealed to the casing with the reactive metal sealing element, and the liner may be suspended from the liner hanger. If the conduit is the tie-back liner, the system may further comprise a liner hanger, and the tie-back liner may be sealed to the liner hanger with the reactive metal sealing element, and the liner may be suspended from the liner hanger.

The preceding description provides various examples of the apparatus, systems, and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for treating a wellbore comprising:

positioning a conduit in the wellbore, wherein the conduit is an expandable liner hanger, wherein the conduit comprises:

a conduit body; and a reactive metal sealing element disposed on the conduit body, wherein the reactive metal sealing element comprises a reactive metal having a first volume; wherein the reactive metal sealing element consists of metal, metal alloy, or a combination thereof; wherein the reactive metal sealing element further comprises a removable barrier coating;

at least one end ring disposed adjacent to the reactive metal sealing element;

mechanically expanding the expandable liner hanger and the reactive metal sealing element;

then contacting the reactive metal with a fluid that irreversibly reacts with the reactive metal to produce a metal hydroxide reaction product having a second volume greater than the first volume; and contacting a surface adjacent to the reactive metal sealing element with the metal hydroxide reaction product to form a permanent seal and anchor the expanded liner hanger with the metal hydroxide reaction product.

2. The method of claim 1, wherein the reactive metal comprises a metal selected from the group consisting of magnesium, calcium, aluminum, tin, zinc, beryllium, barium, manganese, and any combination thereof.

3. The method of claim 1, wherein the reactive metal comprises a metal alloy selected from the group consisting of magnesium-zinc, magnesium-aluminum, calcium-magnesium, aluminum-copper, and any combination thereof.

4. The method of claim 1; wherein the adjacent surface is a casing.

5. The method of claim 1, wherein the conduit body comprises a recess; wherein the reactive metal sealing element is disposed in the recess.

6. The method of claim 1, wherein the conduit comprises two end rings disposed on opposing sides of the reactive metal sealing element.

7. The method of claim 1, wherein the expandable liner hangar is mechanically expanded with an expansion cone.

8. A conduit for a wellbore, wherein the conduit is an expandable liner hanger comprising:

a conduit body;

a reactive metal sealing element disposed on the conduit body, wherein the reactive metal sealing element consists of a reactive metal, reactive metal alloy, or a combination thereof and has a first volume; wherein the reactive meal sealing element is configured to irreversibly react with a reaction-inducing fluid to form a metal hydroxide reaction product having a second volume larger than the first volume; wherein the metal hydroxide reaction product forms a permanent seal and anchors the expandable liner hanger to an adjacent surface; wherein the reactive metal sealing element further comprises a removable barrier coating; and at least one end ring disposed adjacent to the reactive metal sealing element.

9. The conduit of claim 8, wherein the reactive metal comprises a metal selected from the group consisting of magnesium, calcium, aluminum, tin, zinc, beryllium, barium, manganese, and any combination thereof.

10. The conduit of claim 8, wherein the reactive metal comprises a metal alloy selected from the group consisting of magnesium-zinc, magnesium-aluminum, calcium-magnesium, aluminum-copper, and any combination thereof.

11. The conduit of claim 8, wherein the conduit body comprises a recess; wherein the reactive metal sealing element is disposed in the recess.

12. The conduit of claim 8, wherein the conduit comprises two end rings disposed on opposing sides of the reactive metal sealing element.

13. A system for forming a seal in a wellbore comprising:

a conduit, wherein the conduit is an expandable liner hanger comprising:

a conduit body;

a reactive metal sealing element disposed on the conduit body, wherein the reactive metal sealing element consists of a reactive metal, reactive metal alloy, or a combination thereof and has a first volume; wherein the reactive meal sealing element is configured to irreversibly react with a reaction-inducing fluid to form a metal hydroxide reaction product having a second volume larger than the first volume; wherein the metal hydroxide reaction product forms a permanent seal and anchors the liner hanger or tie-back liner to an adjacent surface; wherein the reactive metal sealing element further comprises a removable barrier coating; and at least one end ring disposed adjacent to the reactive metal sealing element; and a liner.

14. The system of claim 13, wherein the adjacent surface is a casing; wherein the system further comprises the casing; wherein the expandable liner hanger is sealed to the casing with the reactive metal sealing element; wherein the liner is suspended from the expandable liner hanger.

15. The system of claim 13, wherein the reactive metal comprises a metal selected from the group consisting of magnesium, calcium, aluminum, tin, zinc, beryllium, barium, manganese, and any combination thereof.

16. The system of claim 13, wherein the reactive metal comprises a metal alloy selected from the group consisting of magnesium-zinc, magnesium-aluminum, calcium-magnesium, aluminum-copper, and any combination thereof.

17. The system of claim 13, wherein the conduit body comprises a recess; wherein the reactive metal sealing element is disposed in the recess.

18. The system of claim 13, wherein the conduit comprises two end rings disposed on opposing sides of the reactive metal sealing element.

* * * * *